United States Patent [19]

Mousselli

[11] 4,342,526

[45] Aug. 3, 1982

[54] SUBMERSIBLE BACKFILL MACHINE

[75] Inventor: Al H. Mousselli, Houston, Tex.

[73] Assignee: Applied Offshore Technology, Inc., Houston, Tex.

[21] Appl. No.: 156,561

[22] Filed: Jun. 5, 1980

[51] Int. Cl.[3] ..... E02F 7/00

[52] U.S. Cl. ..... 405/159; 405/163; 37/63

[58] Field of Search ..... 405/161, 162, 163, 164, 405/158–160, 179; 37/62, 63

[56] References Cited

U.S. PATENT DOCUMENTS

| | | | |
|---|---|---|---|
| 2,693,085 | 11/1954 | Salnikov | 405/162 |
| 3,646,694 | 3/1972 | Beck | 37/62 |
| 4,087,981 | 5/1978 | Norman | 405/161 |

FOREIGN PATENT DOCUMENTS

| | | | |
|---|---|---|---|
| 1286521 | 8/1972 | United Kingdom | 405/163 |

*Primary Examiner*—Dennis L. Taylor

[57] ABSTRACT

Submersible backfill machine for covering a submerged conduit disposed within a trench in a seabottom with material from the sea bottom, which includes a sled positionable over the conduit on the sea bottom. A pump is supported by the sled and is connected to an intake head that is adapted to pick up sea bottom material entrained in water drawn into the pump. A dispersion nozzle is connected to the discharge side of the pump to cause the entrained sea bottom material to settle into the trench and cover the conduit.

9 Claims, 4 Drawing Figures

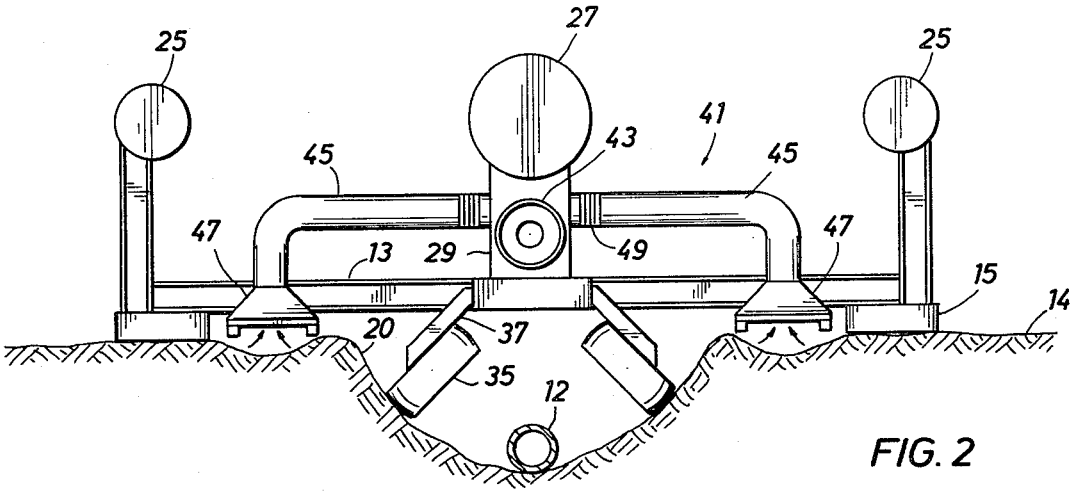
FIG. 2
FIG. 3
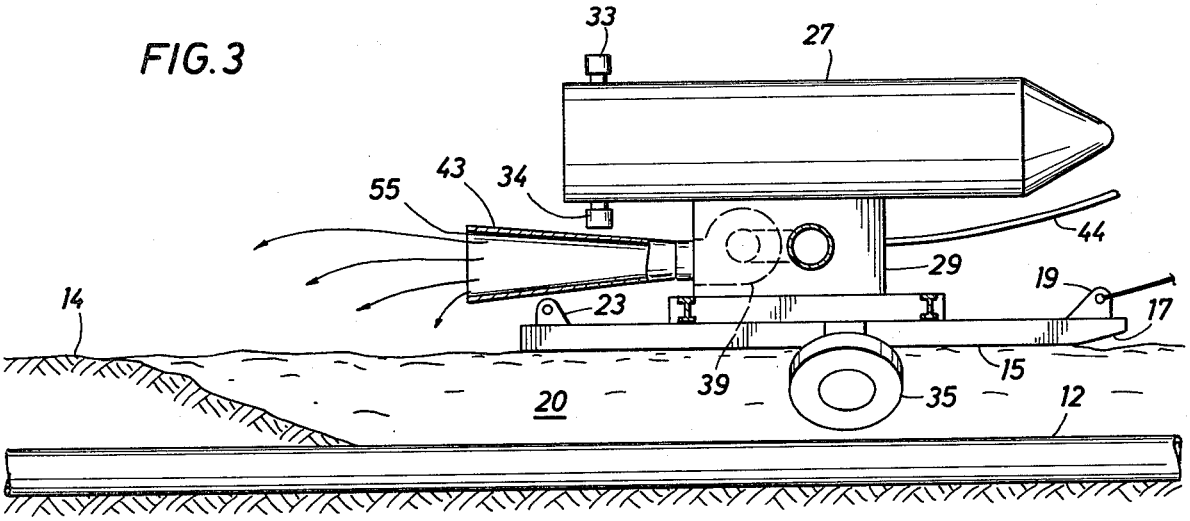
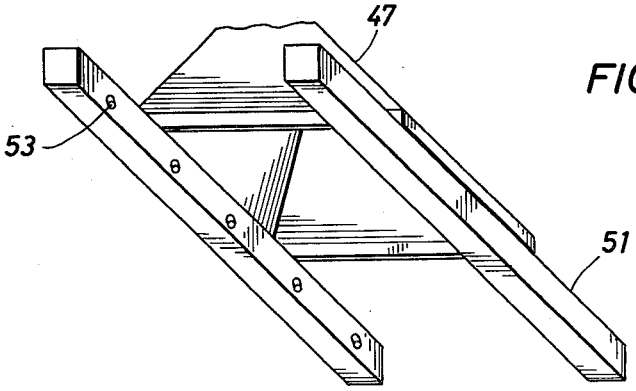
FIG. 4

SUBMERSIBLE BACKFILL MACHINE

BACKGROUND OF THE INVENTION

A. Field of the Invention

This invention relates to apparatus for covering submerged conduit, and more particularly to a submersible apparatus adapted to cover the conduit with material gathered from the sea bottom.

B. Background of the Prior Art

An offshore conduit resting on the sea bottom can be exposed to various hazards, including hydrodynamic forces, fishing trawls, and dragging anchors. Currently, offshore conduits are disposed in trenches cut into the sea bottom by various apparatus, thereby lowering the pipeline below the level of the surrounding sea bottom. However, existing equipment used to dig trenches for submerged conduits do not include positive means for refilling such trenches. In most cases, the trench remains open unless it becomes filled due to the natural motion of the water near the sea bottom. As long as the conduit is not covered, it remains exposed to the majority of hazards that exist along its length.

Various arrangements have been suggested to cover submerged conduits. One such arrangement includes a plow or blade that is towed adjacent to the length of the conduit by a surface vessel. The blade scrapes and moves laterally sea bottom material over the conduit. However, the blade arrangement has a number of disadvantages, including requiring excessive vessel power for towing and threatening to damage the conduit. Another method has included depositing over the conduit material gathered onshore. This method is not satisfactory because of the capacity necessary to bring the material to the conduit location.

SUMMARY OF THE INVENTION

It is therefore an object of the present invention to provide an apparatus that can deposit sea bottom material over a conduit, but that does not endanger the conduit in so doing.

Briefly stated, the foregoing and other objects of the present invention are accomplished by providing an apparatus that includes a sled positionable on the sea bottom over the conduit. The sled supports a pump that is connected to an intake head supported adjacent to the sea bottom. Sea bottom material is entrained with water drawn into the intake head. A dispersion nozzle is connected to the discharge of the pump, which reduces the velocity of the discharge and causes the entrained material to settle and cover the conduit.

The sled is adapted to be towed over the sea bottom and is supported upon skids. Buoyancy tanks are attached to the sled so that the buoyancy of the apparatus may be maintained slightly negative. The slight negative buoyancy of the apparatus enables it to be towed easily and lessens the chances of its damaging the conduit. Wheels are provided for aligning the apparatus with the trench in which the conduit is disposed.

BRIEF DESCRIPTION OF THE DRAWINGS

FIG. 2 is an end section view taken along line 2—2 of FIG. 1.

FIG. 3 is a side section view of the apparatus of the present invention.

FIG. 4 is a detail view of the intake head of the present invention.

DESCRIPTION OF THE PREFERRED EMBODIMENT

Figure 1:
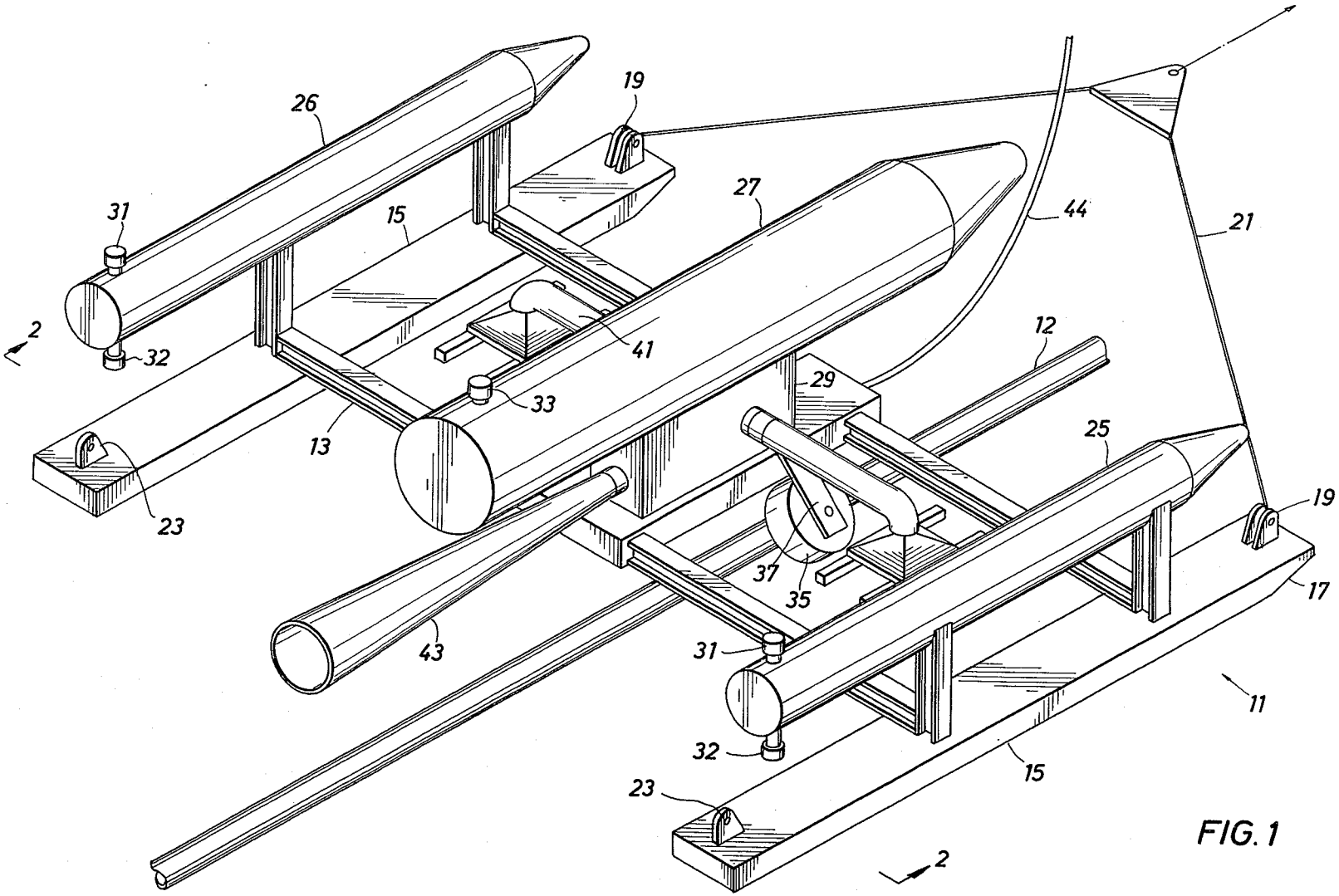
FIG. 1 is a perspective view of the apparatus of the present invention.

Referring now to the drawings, the apparatus of the present invention is designated generally by the numeral 11 and is adapted to straddle a submerged conduit, as, for example, pipeline 12. Apparatus 11 includes a sled 13 that is fabricated from structural members, such as I-beams, and is supported for movement along the sea bottom, designated by the numeral 14 in FIGS. 2 and 3, upon a pair of skids 15. Skids 15 have an upwardly-sloping forward end 17, which enable skids 15 to move more easily over sea bottom 14, and towing and lifting eyes 19. Towing eyes 19 are adapted to receive a towing bridle 21, which is attached to a towline towed by a towing vessel, such as a tug or supply boat. Skids 17 are also provided with a lifting eye 23, which serves as a point of attachment for a lifting line (not shown), which may be used together with pad eyes 19 in moving apparatus 11 to and from sea bottom 14.

To control the buoyancy of apparatus 11, buoyancy tanks are provided, which include a pair of side tanks 25, supported over skids 15, and a central tank 27 supported on a pump housing 29. Side tanks 25 and central tank 27 displace sufficient water when empty such that apparatus 11 is positively buoyant. A system of valves, as for example valves 31 and 32 on side tanks 25 and valves 33 and 34 on central tank 27, is provided for flooding and purging tanks 25 and 27 to maintain apparatus 11 slightly negatively buoyant during use. The slight negative buoyancy allows apparatus 11 to move more easily over sea bottom 14, thereby lessening both the power requirements of the towing vessel and the possibility of damage to the pipeline 12 should a portion of apparatus 11 come in contact therewith.

Apparatus 11 is guided through the trench, designated in FIGS. 2 and 3 by the numeral 20, a pair of wheels 35, which are mounted for rotation on suspension struts 37 mounted to sled 13. In the preferred embodiment, wheels 35 are adapted to straddle pipeline 12 and contact trench 20. However, it is of course recognized that wheels 35 could be adapted to contact pipeline 12 to guide apparatus 11 therealong.

Apparatus 11 transfers material from sea bottom 14 into trench 20 by means of a pump, shown in phantom in FIG. 3 and designated by the numeral 39, that draws material through an intake system, designated generally by the numeral 41, and a dispersion nozzle 43. Pump 39 is disposed within pump housing 29 and in the preferred embodiment is a centrifugal pump adapted to pump water and entrained sea bottom material. In the preferred embodiment, pump 39 is hydraulically operated by fluid pumped from the surface through an umbilical 44. Pump 39 could also be powered by a variable speed electric motor or hydraulic-electric device taking electrical power through an umbilical from the surface.

As best seen in FIG. 2, intake system 41 includes a pair of intake pipes 45 and intake heads 47. Intake pipes 45 are connected to pump 39 through flexible couplings 49, which allow intake heads 47 to follow the contour of seabed 14 as apparatus 11 is dragged therealong.

Referring now to FIG. 4, each intake head 47 includes a tapering, funnel-like structure that is supported for movement along sea bottom 14 on a pair of skids 51. Skids 51 serve to elevate intake head 47 slightly above sea bottom 14 so that water can move into intake head 47 and entrain sea bottom material. To increase the amount of material entrained, a plurality of high-velocity nozzles 53 are provided on the interior surfaces of skids 51. Nozzles 53 provide jets of water to agitate the material on sea bottom 14 and may be supplied with water from umbilical 44 or from a pump mounted on apparatus 11.

The discharge of water and entrained material from pump 39 is directed rearwardly through dispersion nozzle 43. Dispersion nozzle 43 is conical and flares outwardly to a rearward end 55 that is centered over pipeline 12. Dispersion nozzle 43 confines the discharge from pump 39 and reduces the velocity of such discharge to the point where the entrained sea bottom materials are no longer held in suspension. When the water and material leave rearward end 55, the sea bottom material falls into trench 20 and covers pipeline 12.

In operation, after pipeline 12 has been deposited on trench 20, apparatus 11 would be lowered from the surface to sea bottom 14 by cables attached to eyes 19 and 23. With apparatus 11 aligned over pipeline 12 and wheels 35 engaging trench 20, the buoyancy of tanks 25 and 27 are regulated to make apparatus 11 slightly negatively buoyant. With apparatus 11 so aligned, pump 39 is actuated to lift seabed material through intake heads 47 and deposit such material into trench 20 through dispersion nozzle 43. As the sea bottom material is being deposited, apparatus 11 is towed over sea bottom 12 by a towing vessel having a towline attached to towing bridle 21. The speed of tow is determined by the rate at which material is deposited over pipeline 12. It is of course recognized that apparatus 11 could be made self-propelled in one of many ways including Archemedis Screws, tracks, etc.

After the conduit has been covered, apparatus 11 is retrieved and placed on the deck of a support vessel. Lifting cables are attached to eyes 19 and 23 and the negative buoyancy may be reduced slightly by partially purging tanks 25 and 27 through the valving system. The support vessel then lifts apparatus 11 to the surface or to a point near the surface where tanks 25 and 27 may be completely purged. Apparatus 11 is then lifted out of the water and placed upon the deck of the support vessel.

Apparatus 11 can operate over a wide range of soil conditions, and, because of its variable buoyancy capability, over a wide range of sea bottom current and terrain conditions. Also, apparatus 11 may be operated without regard to the method or technique with which pipeline 12 was laid and may be operated in close proximity to sub-sea structures with minimal interference. Apparatus 11 can be operated with the assistance of a diving team or may be automated for diverless operation.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be made in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. Apparatus for covering a submerged conduit disposed within a trench in a sea bottom with material from said sea bottom, which comprises:

a sled positionable over said conduit in said trench on said sea bottom;

a pump supported by said sled, said pump including an intake side and a discharge side;

a pair of intake heads supported by said sled adjacent to said sea bottom on opposed sides of said trench;

means for connecting said intake heads to said intake side of said pump for the flow of water and entrained sea bottom material through said intake heads and into said pump;

and a conical shaped dispersion nozzle supported by said sled and positioned generally over said conduit and between and rearwardly of said intake heads, for directing the flow of water and entrained sea bottom material from said discharge side of said pump over said conduit and for diffusing said flow from said discharge side such that said entrained material settles into said trench to cover said conduit.

2. The apparatus as claimed in claim 1, including means for agitating said sea bottom material in the vicinity of each of said intake heads to facilitate the entrainment of said sea bottom material.

3. The apparatus as claimed in claim 2, wherein said agitating means includes high pressure nozzles for directing fluid into said sea bottom material.

4. The apparatus as claimed in claim 1, wherein said means for connecting said intake heads to said intake side of said pump includes:

a pipe connected to each said intake head;

and a flexible connector connected between each said pipe and said intake side.

5. The apparatus as claimed in claim 1, including means for controlling the buoyancy of said sled.

6. The apparatus as claimed in claim 5, wherein said buoying controlling means includes:

a tank attached to said sled;

and valve(s) connected to said tank to control the flow of water and air into and out of said tank.

7. The apparatus as claimed in claim 1, including means for spacing said intake heads apart from said sea bottom.

8. The apparatus as claimed in claim 1, including means for orienting said sled with said trench.

9. The apparatus as claimed in claim 8, wherein said orienting means includes:

a pair of struts extending from said sled toward said trench;

and a wheel rotatably mounted on each said strut.

* * * * *